United States Patent [19]

Kim

[11] Patent Number: 5,046,330

[45] Date of Patent: Sep. 10, 1991

[54] REFRIGERATOR HUMIDIFIER WITH TERRACED CONDENSATE COLLECTION TRAY

[75] Inventor: Sang-Uk Kim, Suwon, Rep. of Korea

[73] Assignee: SamSung Electronics Co., Ltd., Suwon, Rep. of Korea

[21] Appl. No.: 407,139

[22] Filed: Sep. 14, 1989

[30] Foreign Application Priority Data

Sep. 14, 1988 [KR] Rep. of Korea ..... 88-15151

[51] Int. Cl.[5] ..... F25D 21/14

[52] U.S. Cl. ..... 62/289; 62/285; 62/291

[58] Field of Search ..... 62/285, 288, 291, 290, 62/289

[56] References Cited

U.S. PATENT DOCUMENTS 1,888,043 11/1932 McCord et al. ..... 62/288

3,174,301 3/1965 Thornton et al. ..... 62/291

*Primary Examiner*—Albert J. Makay

*Assistant Examiner*—John Sollecito

*Attorney, Agent, or Firm*—Robert E. Bushnell

[57] ABSTRACT

The moisturizing device of refrigerator wherein the defrosted water used for moisturization is to be automatically changed with fresh water always so that fresh defrosted water may be supplied for moisturization. The structure of the hopper shaped water collection pail is formed which collects the defrosted water used for moisturization dividedly in small units and makes the dividedly collected water in small units over flow and drained successively and continually, resulting always a fixed amount of defrosted water collected in it.

6 Claims, 1 Drawing Sheet

REFRIGERATOR HUMIDIFIER WITH TERRACED CONDENSATE COLLECTION TRAY

BACKGROUND OF THE INVENTION

1. Field of the Invention

This device relates to a moisturizing device of the refrigerator wherein a moisturing water can be maintained freshly, which enables storing goods freshly over a long time and enhancing the tightness of the storing room by the use of defrosted water being naturally evaporated in the storing room of the refrigerator, especially of a direct type of wine cellar in which the foods of or liquors are stored at a low temperature.

2Description of the Prior Art

In the direct type refrigerator or wine cellar that refrigerates goods of or liquors, the evaporator is installed in the closed refrigerator, which directly exchanges the heat of the air in the refrigerator so that the stored goods may be stored at a low temperature.

In this case, since the inside of the refrigerator, being closed as described above, is easily dried, in case that the stored goods are vegetables, their freshness can not be maintained and in case of a wine cellar, the cork sealing part of the stored bottle dries and contracts or cracks thereby loosing its tightness, so moisturizing the inside of the refrigerator is indispensible because of such problems.

By the way, looking at the traditional structure of moisturization, moisturization is done by the way in which defrosted water produced while defrosting the inside of the refrigerator is to be collected in the dish installed on the bottom of the refrigerator, or by storing moisturizing water in a seperate dish.

But in the moisturization as above, since the moisturizing water, stored in the dish, is spoiled when used over a long time, not only do troublesome problem follow, such that moisturizing water must be changed frequently giving users which thus inconvenience users but also the problem of unsanitariness.

SUMMARY OF THE INVENTION

This device is devised considering problems pointed out and it is an object of this device to provide a moisturizing device for a refrigerator wherein the defrosted water used for moisturization is to be automatically changed with fresh water always so that fresh defrosted water may be supplied for moisturization.

Namely this device may be installed as a water collection pail under the evaporator in the refrigerator from which the defrosted water dropping from the evaporator during defrosting caused is to be overflowed and drained continually out of the refrigerator.

Especially, this device is characterized by the structure of the water collection pail wherein several water collection rooms of terraced fashion are formed in which the heights of the rooms are gradually lowered from borders toward the pail center so that the defrosted water dropping from the evaporator may be overflowed from the higher water collection room to the lower room and drained out of the refrigerator automatically and continually, so that the defrosted water used for moisturization may be changed with always fresh water to be moisturized.

DESCRIPTION OF THE PREFERRED EMBODIMENT

The aspects of this device will be more apparent in the following detailed description taken in conjunction with the accompanying drawings.

Figure 1:
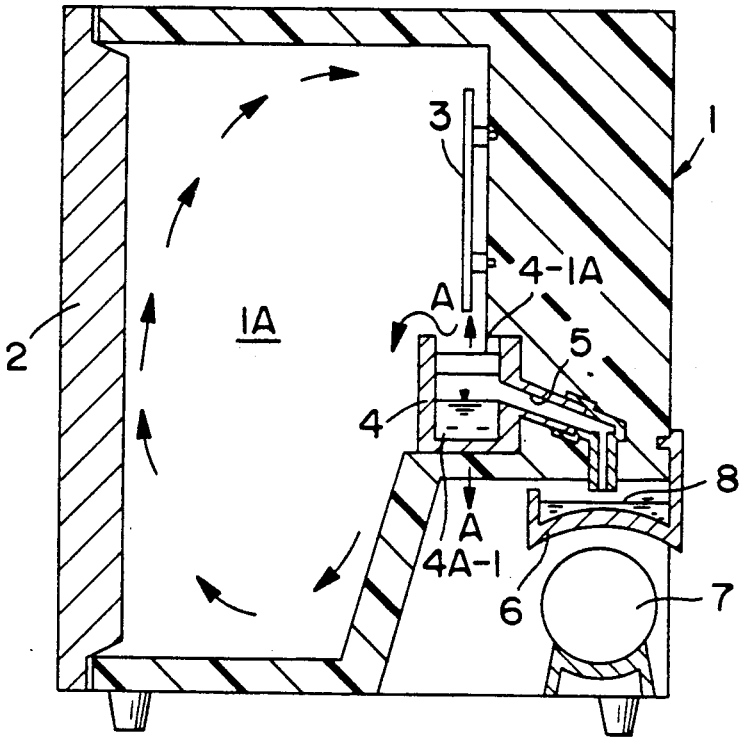
FIG. 1 is the schematic cutout view of the whole refrigerator in which the moisturizing device according to this device is installed.

The drawings show a refrigerator for refrigerating foods or liquors, where FIG. 1 shows the body of the refrigerator. The body 1 of the refrigerator is constructed in a box form, the front side of which is open so that the door 2 with which the storing room 1A is to be closed may be connected to it. And at the wall inside the storing room 1A is installed the evaporator 3, directly under which hopper shaped water collection pail 4 is installed to collect defrosted water dropping from the evaporator during defrosting. And in the hopper shaped water collection pail 4 the heights formed in a terraced fashion are gradually lowered from the borders toward the center by installing several separation walls of the same height at the inclined bottom of the referred hopper shaped water collection pail 4 interspaced at specified distances.

And in the lowest water collection room 4A-1 in the referred hopper shaped water collection pail 4, the draining outlet 5 is installed at a specified height through which the defrosted water is to automatically overflow and continue into the evaporating reservoir 8. This draining material is desirable to have a specified decline. The unexplained symbol, 7 stands for compressor.

Now turning to the functioning of this device structured as described above, this device has the same scheme as the traditional ones in the point of the collection of the defrosted water produced from the evaporator 3 in the refrigerator 1A and the moisturization with the collected defrosted water.

In this device, however, directly under the evaporator 3 is installed the water collection pail wherein the previously collected defrosted water is to be automatically and continually overflowed and drained through the draining outlet 5 out of the refrigerator when the defrosted water is collected upto the specified height, enabling moisturization with always newly fresh defrosted water, giving not only an improved effect on sanitariness but also enhancement of convenience for use by excluding the troublesome work such that the defrosted water which must be manually replaced in the traditional devices.

Figure 2:
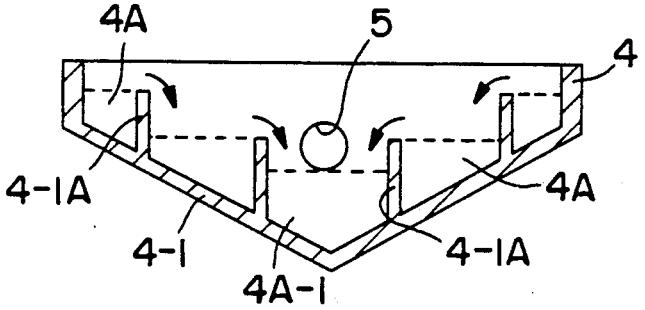
FIG. 2 is the expanded cutout view of the A—A part of FIG. 1.

And in the water collection pail 4 of this device are formed several water collection rooms 4A in terraced fashion the heights of which are gradually lowered from borders toward center, so that the defrosted water dropping from the evaporator may successively overflow continually from the higher water collection room into the lower rooms, and as shown in FIG. 2, in the water collection room 4A of terraced fashion formed in the water collection pail 4, the border side of the bottom of each room is high and the center side is low, so the depth of the water is deeper at the center side than that of the border side.

In this state the defrosted water overflowing from the upper side room flows into into the shallow side of the water in the adjacent lower side room. The inflowing defrosted water referred to above flows along the bottom side of the water collection room, and simultaneously the defrosted water remaining the upper part of the deep side of each room, i.e. the previously collected defrosted water, overflows into the next room as much as the newly inflowing water earlier referred to.

In this way the inflow and overflow in successive and repeated fashion changes the defrosted water in each room with new defrosted water, thereby maintaining its freshness.

As described above, according to the moisturizer in the refrigerator of this device, the troublesome work such that the defrosted water is to be changed manually in traditional devices can be excluded and a large effect on sanitariness is expected by installing the water collection pail, from which the collected defrosted water is overflowed and automatically drained out of the refrigerator, under the evaporator, enabling automatic exchange of defrosted water used for mosturization with fresh, newly defrosted water.

What is claimed is:

1. A refrigerator, comprised of:

a door;

a plurality of walls forming a chamber having an interior wall, said chamber being tightly closed by said door;

an evaporator mounted on and spaced apart from said interior wall;

means disposed beneath said evaporator, for collecting water dripping from said evaporator, said collecting means providing a plurality of successively adjoining chambers each open to receive the water, with said plurality of chambers sharing common dividing means for enabling some of the water from an upper chamber to flow into a lower adjoining chamber while retaining other of the water within the upper chamber, a lowermost one of said chambers containing an overflow conduit communicating through one of said plurality of walls with an orifice spaced vertically above a lowermost depth of said lowermost one of said chambers;

said collecting means comprising a hopper divided into a serial arrangement of said plurality of chambers each open to receive the water dripping from said evaporator, with a central and lowermost one of said chambers separating a plurality of other ones of said chambers arranged in ascending heights on opposite sides of said central one of said chambers, in terraces disposed for each one of said chambers to retain some of the water received and to enable excess of the water received in the other ones of said chambers in the terraces overflow and drain successively, thereby maintaining within said chambers of the hopper some of water collected.

2. The device of claim 1, characterized by the structure of the hopper being shaped as a water collection pail, wherein said chambers are arranged in terraced fashion, with the heights of said chambers being gradually lowered from the extremities of said pail toward the central one of said chambers.

3. A refrigerator comprised of:

a door;

a plurality of walls forming a chamber having an interior wall, said chamber being tightly closed by said door;

an evaporator mounted on and spaced apart from said interior wall;

means disposed beneath said evaporator, for collecting water dripping from said evaporator, said collecting means provided a plurality of successively adjoining chambers each open to receive the water, with said plurality of chambers sharing common dividing means for enabling some of the water from an upper chamber to flow into a lower adjoining chamber while retaining other of the water within the upper chamber, a lowermost one of said chambers containing an overflow conduit communicating through one of said plurality of walls with an orifice spaced vertically above a lowermost depth of said lowermost one of said chambers;

said collecting means comprising a hopper divided into a serial arrangement of said plurality of chambers each open to receive the water dripping from said evaporator, with a central and lowermost one of said chambers separating a plurality of other ones of said chambers arranged in ascending heights on opposite sides of said central one of said chambers, in terraces disposed for each one of said chambers to retain some of the water received and to enable excess of the water received in the other ones of said chambers in the terrances overflow and drain successively, thereby maintaining within said chambers of the hopper some of water collected; said hopper being centrally disposed vertically below said evaporator.

4. The refrigerator of claim 3, further comprised of said hopper being shaped as a water collection pail, wherein said chambers are arranged in terraced fashion; with the heights of said chambers being gradually lowered from the extremities of said pail toward the central one of said chambers.

5. A refrigerator comprised of:

a door;

a plurality of walls forming a chamber having an interior wall, said chamber being tightly closed by said door;

an evaporator mounted on said spaced apart from said interior wall;

means disposed beneath said evaporator, for collecting water dripping from said evaporator, said collecting means providing a plurality of successively adjoining chambers each open to receive the water, with said plurality of chambers sharing common dividing means for enabling some of the water from an upper chamber to flow into a lower adjoining chamber while retaining other of the water within the upper chamber, a lowermost one of said chambers containing an overflow conduit communicating through one of said plurality of walls with an orifice spaced vertically above a lowermost depth of said lowermost one of said chambers;

said collecting means comprising a hopper divided into a serial arrangement of said plurality of chambers each open to receive the water dripping from said evaporator, with a central and lowermost one of said chamber separating a plurality of other ones of said chambers arranged in ascending heights on opposite sides of said central one of said chambers, in terraces disposed for each one of said chambers to retain some of the water received and to enable excess of the water received in the other ones of said chambers in terraces overflow and drain successively, thereby maintaining within said chambers of the hopper some of water collected, said hopper being centrally disposed relative to said evaporator with each of said chambers locatable vertically below said evaporator.

6. The refrigerator of claim 5, further comprised of said hopper being shaped as a water collection pail, wherein said units are arranged in terraced fashion, with the heights of said units being gradually lowered from the extremities of said pail toward the central one of said units.

* * * * *

UNITED STATES PATENT AND TRADEMARK OFFICE
CERTIFICATE OF CORRECTION

PATENT NO. : 5,046,330

DATED : September 10, 1991

INVENTOR(S) : Sang-Uk KIM

It is certified that error appears in the above-identified patent and that said Letters Patent is hereby corrected as shown below:

IN THE ABSTRACT

Line 1, insert --a-- after "of";

Line 9, change "drained" to --drain--;

Line 10, insert --in-- after "ways".

Column 1, Line 8, change "a" to --the--;

Line 9, change "a moisturing" to --moisturizing--;

Line 15, delete "of";

Line 16, insert --.-- after "2";

Line 18, delete "of";

Line 27, insert --,-- after "cracks";

Line 38, change "problem" to --problems--;

Line 40, delete "giving users", and change "inconvenience users" to --inconveniences users,--;

UNITED STATES PATENT AND TRADEMARK OFFICE
CERTIFICATE OF CORRECTION

PATENT NO. : 5,046,330

DATED : September 10, 1991

INVENTOR(S) : Sang-Uk KIM

It is certified that error appears in the above-identified patent and that said Letters Patent is hereby corrected as shown below:

Column 1, Line 54, change "caused is" to --is caused--, and change "be overflowed" to --over flow--;

Line 55, change "drained" to --drain--;

Column 3, Line 2, delete "into" (second occurrence);

LIne 6, insert --in-- after "remaining".

Signed and Sealed this

Twenty-ninth Day of December, 1992

*Attest:*

DOUGLAS B. COMER

*Attesting Officer*

*Acting Commissioner of Patents and Trademarks*